US009387380B2

(12) United States Patent
Montgomery

(10) Patent No.: US 9,387,380 B2
(45) Date of Patent: Jul. 12, 2016

(54) CATCHING GAME

(71) Applicant: Marshall Montgomery, Costa Mesa, CA (US)

(72) Inventor: Marshall Montgomery, Costa Mesa, CA (US)

( * ) Notice: Subject to any disclaimer, the term of this patent is extended or adjusted under 35 U.S.C. 154(b) by 0 days.

(21) Appl. No.: 14/322,100

(22) Filed: Jul. 2, 2014

(65) Prior Publication Data

US 2015/0290512 A1 Oct. 15, 2015

Related U.S. Application Data

(60) Provisional application No. 61/978,702, filed on Apr. 11, 2014.

(51) Int. Cl.

| | |
|---|---|
| ***A63B 67/06*** | (2006.01) |
| ***A63B 43/00*** | (2006.01) |
| ***A63B 71/06*** | (2006.01) |
| ***A63B 37/00*** | (2006.01) |
| ***A63B 67/00*** | (2006.01) |

(52) U.S. Cl.

CPC ..... *A63B 67/002* (2013.01); *A63B 37/00* (2013.01); *A63B 43/00* (2013.01); *A63B 67/06* (2013.01); *A63B 71/06* (2013.01); *A63B 2243/007* (2013.01)

(58) Field of Classification Search

CPC ..... A63B 37/00; A63B 43/00; A63B 71/06; A63B 67/06; A63B 43/008; A63B 69/002; A63B 2071/0602; A63B 2243/007; A63B 2220/00; A63B 2220/17; A63B 2220/50

See application file for complete search history.

(56) References Cited

U.S. PATENT DOCUMENTS

| | | | | | |
|---|---|---|---|---|---|
| 906,932 | A | * | 12/1908 | Riblet | 40/327 |
| 1,587,580 | A | * | 6/1926 | Dutton | 273/146 |
| D92,721 | S | * | 7/1934 | Jary | D21/712 |
| D198,219 | S | * | 5/1964 | Johnson | D21/373 |
| 3,370,851 | A | * | 2/1968 | Murray | 473/438 |
| 3,425,693 | A | * | 2/1969 | Murray | 473/438 |
| 3,931,971 | A | | 1/1976 | Harvey | |
| 4,309,038 | A | * | 1/1982 | Spoon | 473/596 |
| 4,796,888 | A | * | 1/1989 | Louez | 446/243 |
| 5,133,550 | A | * | 7/1992 | Handy | A63B 37/14 473/596 |
| 5,228,687 | A | * | 7/1993 | Luecke et al. | 473/596 |
| 5,511,782 | A | | 4/1996 | Maley | |
| 5,526,326 | A | * | 6/1996 | Fekete | A63B 43/00 368/10 |
| 5,564,702 | A | * | 10/1996 | Meffert | 273/153 R |
| D382,611 | S | * | 8/1997 | Lai | D21/713 |
| 5,779,578 | A | * | 7/1998 | Calandro | 473/599 |
| 6,331,151 | B2 | * | 12/2001 | Calandro | 473/599 |
| 6,422,558 | B1 | * | 7/2002 | Chambers | 273/146 |
| 6,464,602 | B1 | * | 10/2002 | Rottger | 473/571 |

(Continued)

OTHER PUBLICATIONS http://couchpotatofoothallthegame.com. (2011). Access Oct. 10, 2014.

*Primary Examiner* — Steven Wong

(74) *Attorney, Agent, or Firm* — Stout, Uxa & Buyan, LLP; Carlos A Fisher

(57) ABSTRACT

The present application is directed to methods and apparatus for playing a throwing game, employing a ball in which the surface of the ball is divided into zones, with indicia contained in each zone. In preferred examples, the ball is shaped like a football, and the indicia indicate number of points to be awarded, if any. Preferably a player catching the ball will receive the number of points indicated by the indicia within a zone on which the catching player's thumb lands. Reach player's points are added in a running tally. The invention also concerning a ball to be used in such a game.

7 Claims, 4 Drawing Sheets

(56) References Cited

U.S. PATENT DOCUMENTS

| | | | | |
|---|---|---|---|---|
| D474,518 | S * | 5/2003 | Westlund | D21/713 |
| 6,582,330 | B1 * | 6/2003 | Rehkemper | A63B 41/00 446/484 |
| D500,108 | S * | 12/2004 | Carbonero | D21/707 |
| D503,760 | S * | 4/2005 | Chang | D21/712 |
| 6,908,662 | B2 * | 6/2005 | Pearce | 428/188 |
| D510,608 | S * | 10/2005 | Carbonero | D21/713 |
| D518,529 | S * | 4/2006 | Carbonero | D21/457 |
| D519,588 | S * | 4/2006 | Carbonero | D21/707 |
| D551,308 | S * | 9/2007 | Chang | D21/712 |
| D629,854 | S * | 12/2010 | Edison | D21/708 |
| 8,758,172 | B2 * | 6/2014 | Creguer | A63B 71/0622 473/422 |
| D712,988 | S * | 9/2014 | Sagedahl | D21/713 |
| 8,936,523 | B2 * | 1/2015 | Manners | A63B 69/002 473/422 |
| 2003/0203777 | A1 * | 10/2003 | Dubow et al. | 473/569 |
| 2006/0105866 | A1 * | 5/2006 | Ma | A63B 41/08 473/603 |
| 2007/0129188 | A1 * | 6/2007 | Maziarz | A63B 41/00 473/603 |
| 2008/0293520 | A1 * | 11/2008 | Brown | 473/446 |
| 2010/0075776 | A1 * | 3/2010 | Nardacci et al. | 473/371 |
| 2010/0304905 | A1 * | 12/2010 | Karabed et al. | 473/603 |
| 2011/0287878 | A1 * | 11/2011 | Englert | 473/570 |
| 2013/0090186 | A1 | 4/2013 | Edison | |
| 2013/0217502 | A1 * | 8/2013 | Takahashi et al. | 463/42 |
| 2013/0316856 | A1 * | 11/2013 | Jennings | 473/438 |
| 2015/0005117 | A1 * | 1/2015 | Martyn | 473/595 |

* cited by examiner

CATCHING GAME

REFERENCE TO RELATED APPLICATIONS

This application claims priority to U.S. Provisional Patent Application No. 61/978,702, filed Apr. 11, 2014, which is hereby incorporated by reference herein in its entirety.

FIELD OF THE INVENTION

The present invention is directed to an entertainment-based apparatus and game method in which an object, such as a ball, is thrown between two or more people and points are scored based upon how the ball is caught.

BACKGROUND

Games using objects thrown between people must have been played since time immemorial. The use of a ball, as the essential feature in many forms of gameplay requiring physical exertion, must date from the very earliest times. A rolling object appeals not only to human babies, but to cats (particularly kittens), dogs (particularly puppies), and various other carnivores.

Some form of game with a ball is found portrayed on Egyptian monuments. In the *Odyssey* of Homer, which is believed to have been written in the 8th century B.C., Nausicaa is described as playing at ball with her maidens when Odysseus first saw her in the land of the Phaeacians (now Corsica). Furthermore, Halios and Laodamas are described as having performed before Alcinous and Odysseus with ball play, accompanied with dancing, in the same location. By contrast, the scriptures of the Israelites have no mention of the use of a ball, much less of "ball games".

Among the later Greeks, games with balls were regarded as a useful training substitute to more violent athletic exercises and warfare, as a means of keeping the body supple, and rendering it graceful. However, ball games were generally left to boys and girls. It is not clear whether regular rules for the playing of ball games were made; if so, very few traces of such rules remain.

The ancient Romans used leather balls which were solid or filled with air. In the present patent application, the term "ball" need not refer to a spherical object; for example, various prolate spheroid or "cigar shaped" balls are used in American, Canadian, and Australian football and in rugby.

Although many types of balls are today made from rubber or a synthetic polymer, this form was unknown outside the Americas until after the voyages of Columbus. The Spanish were the first Europeans to see bouncing rubber balls (albeit solid and not inflated); these balls were employed most notably in the game called the "Mesoamerican ball game". Balls used in various sports in other parts of the world prior to Columbus were made from other materials such as animal bladders or skins, stuffed with various materials.

In about 1970 the Parker Brothers company began marketing a polyurethane volleyball under the trademark "Nerf®". Marketing slogans promised that one can "Throw it indoors; you can't damage lamps or break windows. You can't hurt babies or old people." The four-inch (102 mm) ball was followed by a large version called "Super Nerf® Ball". Shortly after, in 1972, a basketball game called "Nerfoop" and the Nerf® football joined the family, with the latter quickly becoming the most popular Nerf® ball.

A website located at couchpotatofootballthegame.com is drawn to a smartphone app virtual football game employing a virtual football depicted as landing on various objects in the interior of a room. According to this website, the app plays the game as follows: a touchdown (6 points) is scored by the virtual football landing on the couch and staying on the couch; a touchdown and a 1 point conversion (7 points) is scored by the virtual football hitting the pizza box or cans and landing on the couch; a touchdown and a 2 point conversion (8 points) is scored by the virtual football hitting the lamp and landing on the couch; a field goal (3 points) is scored by the virtual football landing in the space behind the couch; a safety (2 points) is scored by the virtual football hitting the pizza box, cans, or lamp and not landing on the couch; and a fumble or interception (0 points) occurs when the virtual football does not hit the pizza box, cans, or lamp, or land on the couch.

Maley, U.S. Pat. No. 5,511,782 discloses a ball game device and method. The device comprises a spherical body having eight equally-sized faces; the faces are flat-surfaced so that they can rest upon a playing surface. The game is played so that the face facing upwardly on the surface after the ball comes to rest after being kicked, struck or rolled determines the fate of the user in the ball game. The faces have indica displayed that indicate the outcome in a baseball game.

Carbonero, U.S. Design Pat. No. D510,608 is drawn to an ornamental design for a strike zone pattern for a sport ball.

Edison, U.S. Patent Publication US 2013/0090186 is drawn to a golf game using golf balls having a plurality of markings, each marking, if the very top of the ball displays such marking, relating to a future action; generally such action being the type of club to be used in a future shot.

Harvey, U.S. Pat. No. 3,931,971 is drawn to a projectile to be used as an amusement device and having six indented planar surface areas containing raised indicia.

Chambers, U.S. Pat. No. 6,422,558 is drawn to a method of initiating interaction between clients and psychological therapists using a game piece having patches corresponding to general topics or issues for discussion.

SUMMARY OF THE INVENTION

The present invention is directed to a game played using a ball. In currently preferred embodiments the game is capable of being played indoors, although there is no feature of the game that limits the location in which it may be played, so long as there is sufficient room in which to throw and catch the ball.

While often the ball will be either spherical or cigar-shaped, like an American football, there is no limitation of the shape of the ball. Indeed, any object, of any shape or size, capable of being thrown or caught by a person shall be referred to herein as a "ball".

In preferred examples, the ball game is preferably played indoors. Thus, very preferably, the ball is designed and structured to be lightweight, and to lack significant mass, so as not to damage lamps, furniture, windows and the like. In preferred but non-exclusive examples, the ball is a football-shaped ball made from a foam rubber-type material, such as a polyurethane polymer. Such balls are commonly known as "Nerf®" balls and may be ideal for indoor play of the game of the claimed invention.

However, the ball may alternatively be made from materials including leather, other synthetic polymers, and/or latex. The ball may be solid or partially or completely hollow. If the ball is hollow or hollowed, it may (but need not) be wholly or partially filled with another material, such as sand or even a liquid. Of course, while it is particularly preferred that the game be played as an indoor game, the game may be played outdoors as well.

According to the present invention, the ball is thrown by one person, and caught by another person. Points are generally allocated depending on how the ball is caught. The outer surface of the ball is divided into zones, with each zone having a value; such as a numerical value, the lack of a numerical value, a multiplier, a subtraction factor, and the like. When the ball is caught, the zone(s) touched by a pre-determined part of the catcher's body, such as one or more finger (e.g., a thumb, a forefinger, a middle finger, a ring finger and/or a little finger), or less preferably another other part of the body such as a foot, the head, or a hip) on the outer surface of the ball and the associated value is noted. If the location on the ball of more than one finger is predetermined to be part of the game, the numerical values of each zone touched by one or more finger is be noted.

The values noted may be treated in any of various ways. In a preferred example of the game of the present invention, the values accumulated by each player are added together as the game progresses. The winner of one round of the game may, for example, be determined to be the player who reaches the highest score after an equal number of catches by each player, or may be the first player to reach a pre-determined number of points. Other means of determining the end of play, such as expiration of a given time period, may be agreed between players before the start of play.

The number of players may be two or more.

DETAILED DESCRIPTION OF THE INVENTION

In a preferred example, the ball is shaped like an American football. The size of the ball may be the same size as a football, or somewhat smaller than a football. Preferably the ball is made from a soft foam rubber (polyurethane), although the football may be made from leather and/or plastic or rubber, and may be solid or wholly or partly hollow. The ball may be inflated with air.

Also in a preferred example, the ball may be marked with a plurality of indicia, such as values. For example, numerical values and/or football terms such as "turnover, "interception", field goal", "fumble", and the like may be printed on or around the circumference of the ball, for example, at or across its widest radius. The number of "zones" containing such indicia may be chosen as the players wish, however care should be taken to avoid making it difficult to determine where a finger or thumb touches the ball, for example, by making the zones too numerous or small. In a preferred example of the game, the players count score based on where a thumb lands (e.g., within which zone the thumb or finger lands) on the outer surface of the football when the football is caught.

Figure 1:
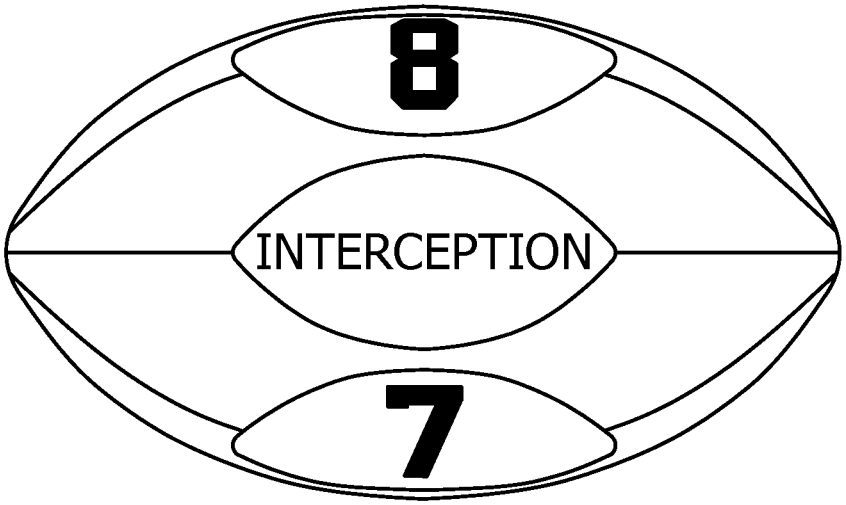
FIG. 1 is a view of a football marked in accordance with one example of this invention, with the term "Interception" showing within a black ovoid shape.
Figure 2:
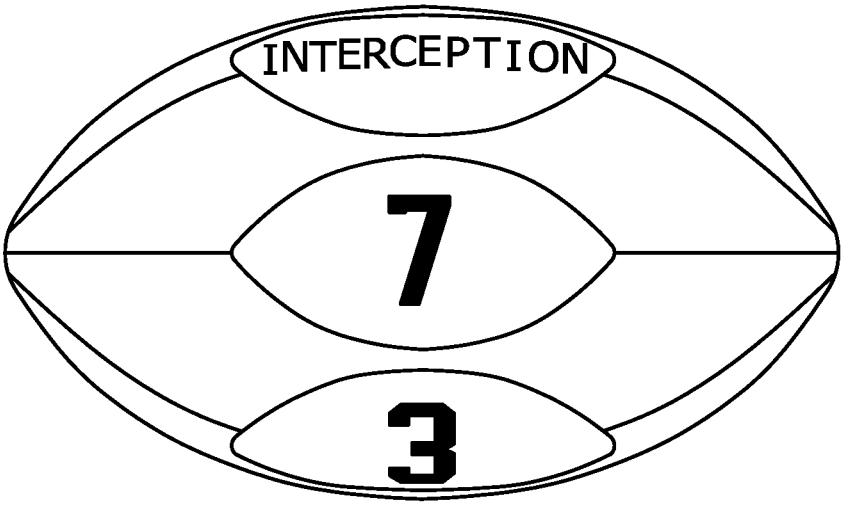
FIG. 2 is a view in which the football of FIG. 1 has been turned approximately 51 degrees to reveal the marking "7" positioned within a black ovoid shape.
Figure 3:
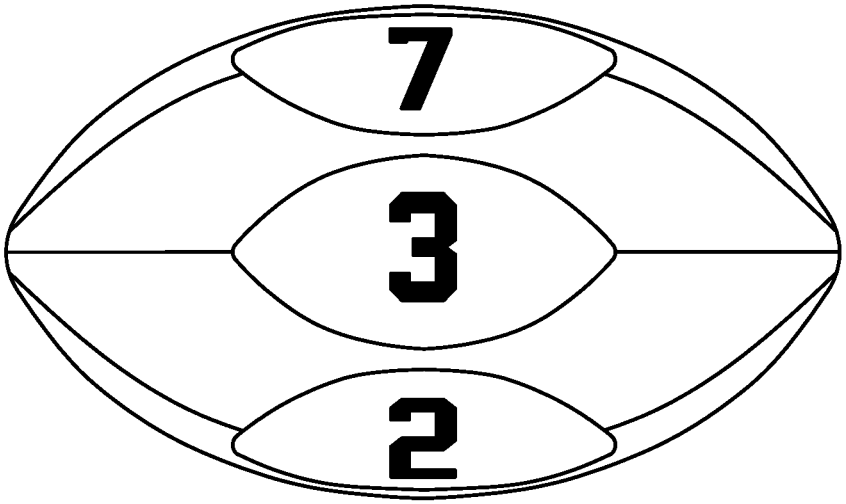
FIG. 3 is a view in which the football of FIG. 2 has been turned approximately 51 degrees to reveal the marking "3" positioned within a black ovoid shape.
Figure 4:
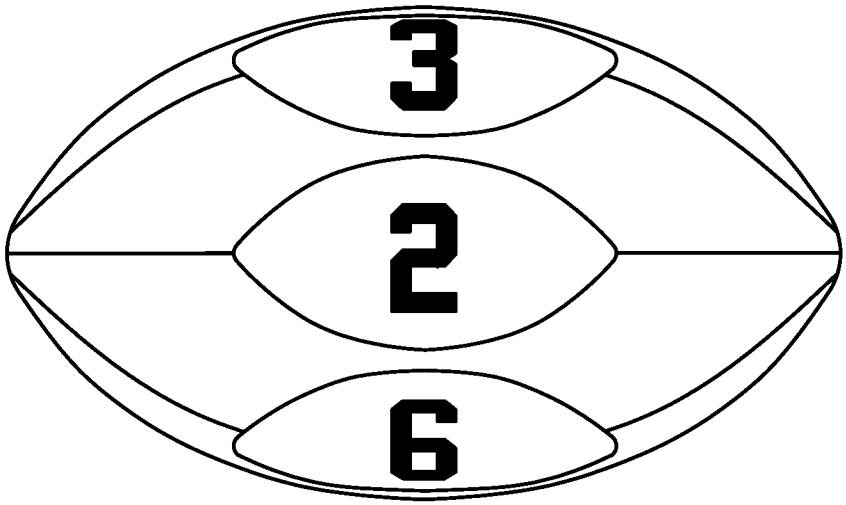
FIG. 4 is a view in which the football of FIG. 3 has been turned approximately 51 degrees to reveal the marking "2" positioned within a black ovoid shape.
Figure 5:
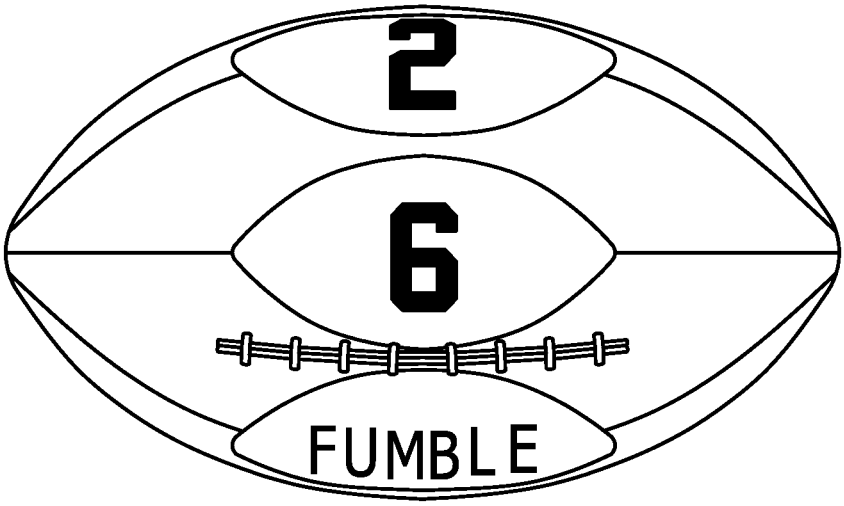
FIG. 5 is a view in which the football of FIG. 4 has been turned approximately 51 degrees to reveal the marking "6" positioned within a black ovoid shape.
Figure 6:
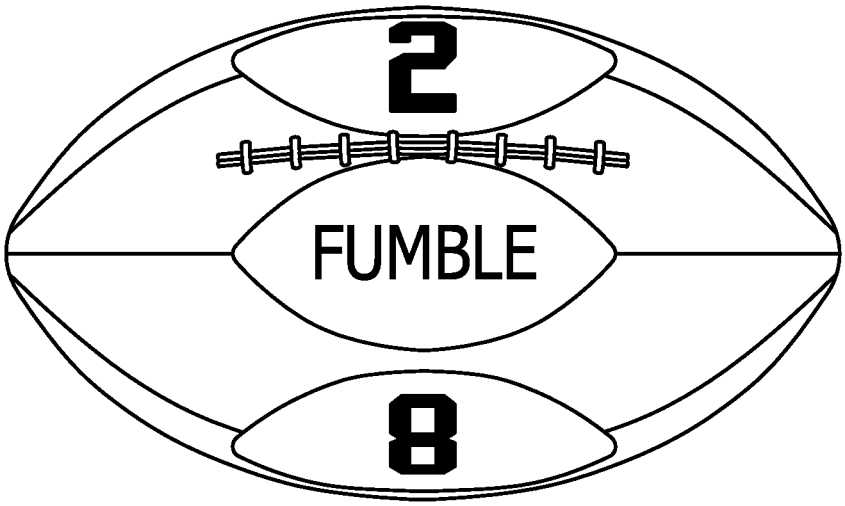
FIG. 6 is a view in which the football of FIG. 5 has been turned approximately 51 degrees to reveal the marking "Fumble" positioned within a black ovoid shape.
Figure 7:
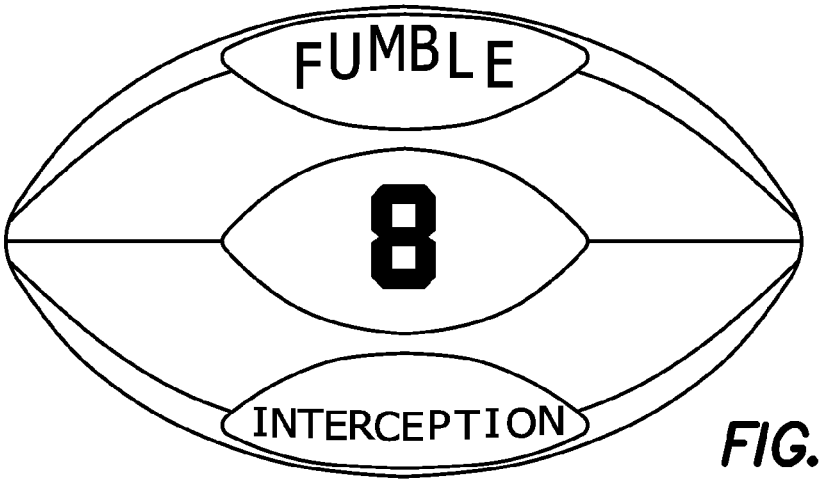
FIG. 7 is a view in which the football of FIG. 6 has been turned approximately 51 degrees to reveal the marking "8" positioned within a black ovoid shape.
Figure 8:
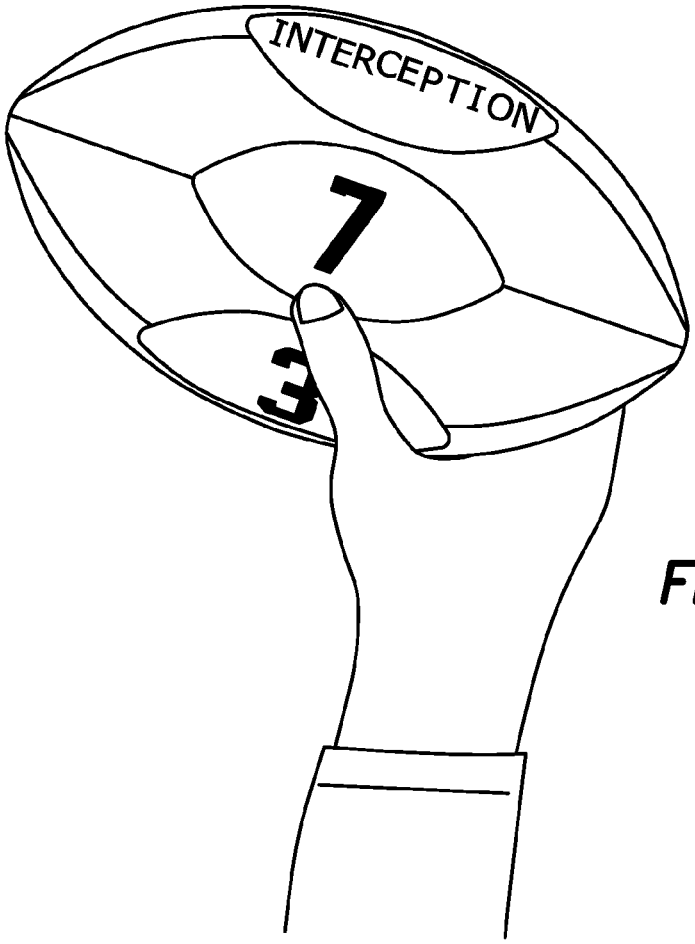
FIG. 8 is a depiction of a catching player whose thumb is located within the zone having the indicia "7".

In the ball shown in FIG. 1-7, the circumference is divided into seven zones. As shown in these Figures, the zones are marked, in order, as follows: Interception, 7, 3, 2, 6, Fumble, and 8.

In another example (not shown) the scoring method can be marked as follows: Safety (2 points), Field Goal (3 points), Touchdown (6 points), Touchdown plus extra point (7 points), Touchdown plus conversion (8 points).

The indicia may be applied to the outside surface of the ball by any suitable method; for example, by using paint, decals, appliques, embossing and the like.

In other examples the ball may be constructed to have implanted sensors, such as digital sensors, which record the location of the thumb when the ball is caught; such sensors may display the indicia or value, or may transmit the indicia, for example, to a microprocessor for scorekeeping.

The values accumulated by each player in tossing the ball between the players are recorded. In this specification "recording" shall include remembering; that is, consigning the value to memory. Each value is also processed as agreed in advance between the parties. Preferably, the processing is an addition function. The result of processing each new value obtained by a player in view of the preceding value may also be done mentally, in writing, or using a computing device.

In one example, the ball contains sensors within each zone that automatically count the value within the zone first touched by a digit, such as by a thumb, when the ball is caught. For example, without limitation, the ball may display these values on the surface of the ball (such as by an LED display or a floating member such as those seen in the Magic 8 Ball® fortune telling toy manufactured by Mattel, Inc.

In certain examples the ball may count score within the zone first touched by a digit, such as by a thumb, when the ball is caught, and wirelessly transmit the score to a microprocessor, such as (without limitation), a smartphone, tablet computer or laptop computer, which will tablulate and provide a running tally of each player's score automatically.

Example 1

A game of catch is played between two players using a Nerf® football divided into 7 zones, as depicted in FIG. 1-7. A first player throws the ball to a second player, who must catch the ball with one hand only; the other hand may be used to steady the ball, so long as it is not used to grip the ball.

The catching player catches the toss from the throwing player, and the indicia located within the zone of the ball on which the thumb of the catching player lies is counted for the catching player. If the catching player's thumb does not lie within any zone, the toss may be repeated. Once a catching player makes a catch, the roles are reversed and the throwing player becomes the catching player and vice versa.

Catches are alternated, and running sums are made of each player's number of points. When both players have made 20 scorable catches, the player with the greatest number of points wins.

Example 2

A plurality of players engage in the throwing game of the present invention. Each player catches the ball the same number of times (such as, for example, 10 times or 20 times). The ball is a football-shaped soft ball containing sensors within each zone. Each sensor wirelessly transmits a signal directly or indirectly to a smartphone running a software application written to receive such signals, count the catches per player, provide a running tally adding the points scored in each catch to previous subtotals for each catching player, and indicate a winner for each game when the indicated number of catches is reached.

In this example, preferably the software application or the ball (or both) is configured to register values only for the first digit touching a zone of the ball within a predetermined period, such as a 20 second period of time, which can be programmed into the application before beginning play.

Although aspects of the present invention have been described with reference to the disclosed embodiments, one skilled in the art will readily appreciate that the specific examples disclosed are only illustrative of these aspects and in no way limit the present invention. Various modifications can be made without departing from the spirit of the present invention. Each and every feature described herein, and each and every combination of two or more of such features, is included within the scope of the present invention provided that the features included in such a combination are not mutually inconsistent. Furthermore, any composition or apparatus of the invention will be understood to comprise, consist essentially of, or consist of one or more element of the claim, and additionally, each and every element not specifically included as an element of a claim shall be considered to have basis herein to be specifically excluded in a negative limitation from that claim.

Any and all patents, publications, patent applications, and nucleotide and/or amino acid sequences referred to by accession numbers cited in this specification are hereby incorporated by reference as part of this specification in its entirety.

I claim:

1. A prolate spheroid-shaped ball, structured to be lightweight, having a surface comprising a plurality of zones arranged around the circumference of the ball, with each said zone being at least as large as a human thumb, and displaying a word or number selected from the group consisting of: Interception, 0, 7, 3, 2, 6, Fumble, 8, Turnover, Safety, Field Goal, Touchdown, Touchdown plus Extra Point, and Touchdown plus Conversion visible on the surface of the ball, and wherein said ball contains a touch-sensitive sensor associated with each zone structured to register score information when a body appendage touches a zone.

2. The ball of claim 1 wherein the ball comprises a foam polymer.

3. The ball of claim 1 wherein said ball is in the shape of an American football.

4. The ball of claim 3 wherein said ball comprises a foam polymer.

5. The ball of claim 4 wherein each zone of said plurality of zones are equal in size and shape to each other zone.

6. The ball of claim 1 wherein said sensor transmits said score information to a microprocessor for calculating a score.

7. The ball of claim 6 wherein said score information is wirelessly transmitted to said microprocessor.

* * * * *